US005848441A

United States Patent [19]

Smith et al.

[11] Patent Number: 5,848,441

[45] Date of Patent: Dec. 15, 1998

[54] PRESSURE ASSIST TOILET

[76] Inventors: Wade W. Smith, 3311 Round Hill Rd., Branchburg, N.J. 08876; David A. Saar, 8 Bennington Dr., Lawrenceville, N.J. 08648

[21] Appl. No.: 805,761

[22] Filed: Feb. 25, 1997

[51] Int. Cl.[6] ..... E03D 1/18

[52] U.S. Cl. ..... 4/334; 4/355

[58] Field of Search ..... 4/334, 335, 336, 4/354–361, 337–339

[56] References Cited

U.S. PATENT DOCUMENTS 1,033,792 7/1912 Gaylord ..... 4/335
5,361,426 11/1994 Martin ..... 4/354 X
5,553,333 9/1996 Andersson ..... 4/361 X

FOREIGN PATENT DOCUMENTS 0007900 4/1910 United Kingdom ..... 4/334

*Primary Examiner*—Charles E. Phillips
*Attorney, Agent, or Firm*—Spencer T. Smith

[57] ABSTRACT

A pressure assist toilet includes a gravity flow bowl, a gravity flow tank, and a thin walled pressure tank. The thin walled pressure tank is selectively configured to have a rectanguloid shape for insertion into the gravity flow tank and having strengthened areas to enable said thin walled pressure tank to be pressurized to about 20 PSI. The thin walled pressure tank is charged with a predetermined volume of water at about 20 PSI, and the charge is released from the thin walled pressure tank to the gravity flow bowl.

6 Claims, 3 Drawing Sheets

PRESSURE ASSIST TOILET

BACKGROUND OF THE INVENTION

The present invention relates to tank type toilets and more particularly to pressure assist tank toilets.

Today's tank type toilets are restricted to a use of 1.6 gallons per flush. To increase the effectiveness of a flush, a conventional gravity flow toilet can be replaced with a pressure assist toilet. In conventional pressure assist toilets, following each flush, 1.6 gallons of water is introduced into a pressure tank in the form of a canister which has a cylindrical body with spherical ends (a standard pressure canister), and is pressurized to 35 PSI. When the toilet flush handle is operated, this pressurized 1.6 gallons of water will be discharged into the bowl of the toilet to flush the toilet. Because the standard pressure canister is normally pressurized, the A.S.M.E. pressure vessel code requires vessel strength which causes manufacturers to design the standard pressure canister of injection molded parts made on costly tools.

A conventional gravity flow china tank is too small (front to back) to accommodate the standard pressure canister and accordingly a special china tank which is substantially larger (front to back) was developed to accommodate the canister. Because the pressure assist tank and canister assembly defined by the special, enlarged china tank and the contained standard pressure canister is deeper front to back, it will not fit onto a conventional toilet bowl designed for use with a smaller gravity tank. Toilet bowls for use with pressure assist tanks are specially designed to be longer front to back to accommodate the larger china tank. Furthermore, since the standard pressure canister discharges under 22 to 35 lbs pressure, similar to a commercial flush valve operating at line pressure, a conventional gravity flow toilet bowl can not be used. The toilet bowl must be specially designed to accommodate this pressure. Further, the standard pressure canister contains cold water so that the outer china tank must be leak tight to contain condensate which forms on the outside of the canister. It is accordingly not surprising that pressure assist toilets are very expensive requiring a commercial type bowl which is much larger and much more expensive than a gravity flow bowl, requiring a special china tank which also is larger than a gravity flow tank and also more expensive because of its size and its limited production, and requiring an injected molded canister made with expensive tools.

An alternate design for the pressure assist toilet has been developed to reduce its cost. In this alternate design, the injection molded standard pressure canister is replaced with a much less expensive blow molded canister which also has a cylindrical body with spherical ends. This blow molded canister can be used because it is not pressurized beyond 20 PSI and because it is normally empty, being filled and pressurized only briefly when the toilet is flushed. While this canister is less expensive, it still requires the special larger china tank and the expensive larger commercial type bowl and this is very undesirable.

OBJECT OF THE INVENTION

It is accordingly an object of the present invention to provide a pressure assist toilet which includes a conventional gravity flow tank which can be mounted on any gravity flow toilet bowl.

Other objects and advantages of the present invention will become apparent from the following specification and the accompanying drawings which illustrate in accordance with the mandate of the patent statutes, a presently preferred embodiment of the invention.

BRIEF DESCRIPTION OF THE PREFERRED EMBODIMENT

Figure 1:
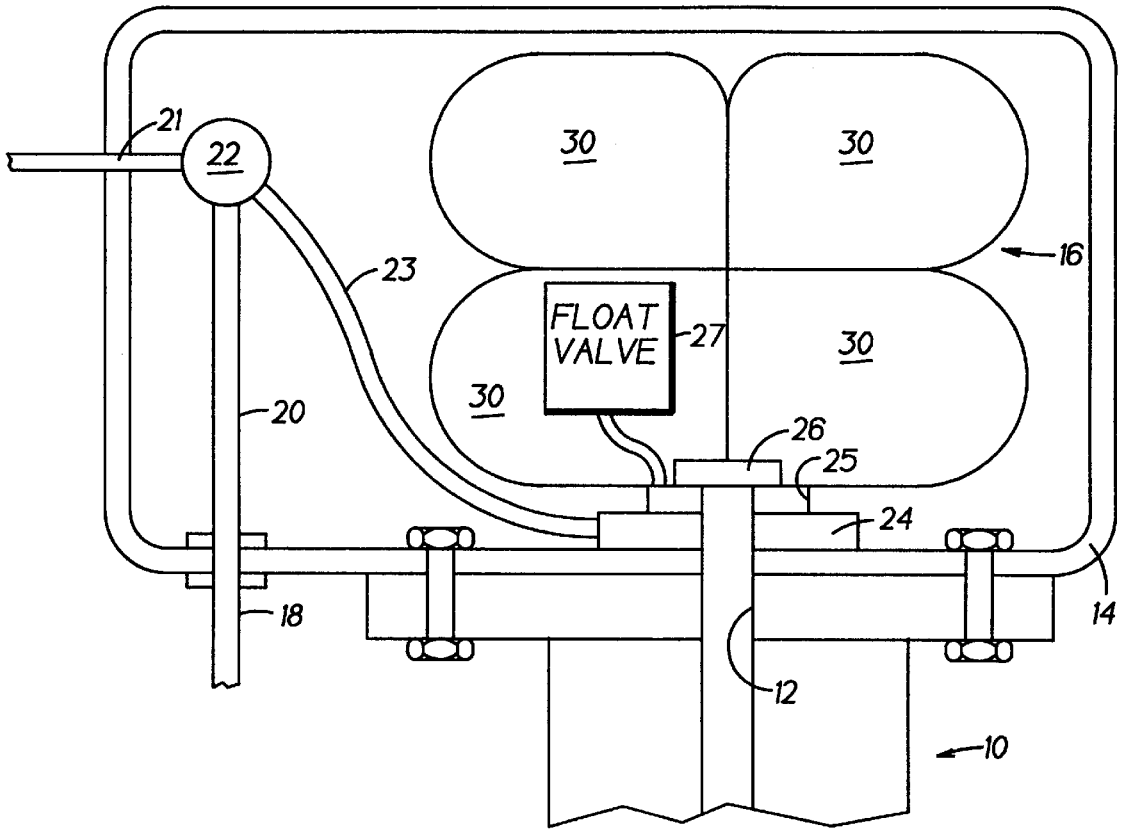
FIG. 1 is an elevational view of the toilet tank portion of a pressure assist toilet made in accordance with the teachings of the present invention.
Figure 2:
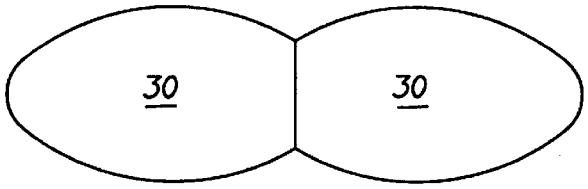
FIG. 2 is a top view of the water receiving canister of the toilet tank portion shown in FIG. 1.
Figure 3:
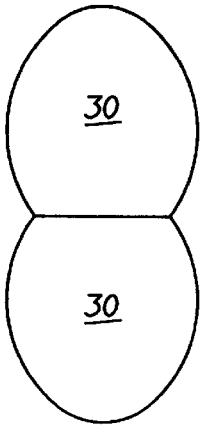
FIG. 3 is side view of the water receiving canister.
Figure 4:
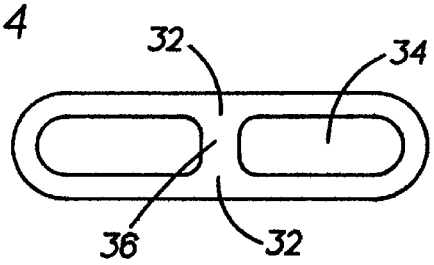
FIG. 4 is a sectional view taken at any of the four locations where one of the four canister portions merges with another canister portion.

The toilet has a bowl 10, which can be any bowl designed for use with a gravity flow tank. The bowl has a water inlet 12. Mounted on the bowl is a china ("china" includes other materials such as composite plastic) outer gravity flow tank 14 (it has the dimensions of a conventional gravity flow tank) in which is located an inner pressure tank (canister) 16. A water supply line 18 which supplies water at household line pressure, ranging from 20 PSI to 80 PSI, is connected to an inlet line 20 within the tank which is connected to a flush handle 21 and valve 22 assembly. When the flush handle 21 is operated, the fill valve 22 opens to allow water to pass through the fill tube 23, through the discharge valve assembly 24 which is secured to a bottom mounting flange 25 of the pressure tank which extends downwardly from the substantially flat bottom of the canister and which includes a movable discharge valve 26, and through a float valve 27, and into the pressure tank. When 1.6 gallons has been introduced into the pressure tank and the pressure within the pressure tank reaches a maximum pressure of from 15–20 PSI, the float valve 27 closes the fill tube which in turn triggers open the flush valve 26 which allows the 1.6 gallons of water to be discharged to flush the bowl (it has been determined that a conventional gravity flow bowl 10 can be flushed with water within a pressure tank where the charging process is limited to a pressure of up to about 15 to 20 PSI).

The inner pressure tank (canister) 16 shown in FIGS. 1–4 is manufactured from plastic in a blow mold process. The canister is substantially rectanguloid having external dimensions selected so that the pressure tank can be located within the conventional gravity flow china tank 14. The outer configuration of the canister is modified to define reinforcing elements to strengthen it. In the preferred embodiment the canister is designed to include four canister portions 30 each having the general shape of a standard pressure canister. The four canister portions are arranged in side by side pairs which are vertically stacked to form a rectanguloid volume. Where adjacent portions merge, structural webs 32 are defined with large internal openings 34 establishing communication therebetween. The size of these structural webs 32 can be increased and cross rods 36 can be defined across these openings to further strengthen the pressure tank (canister). The openings 34 between the portions have a sufficient size so that water can enter and drain from the tank at the desired rate.

Figure 5:
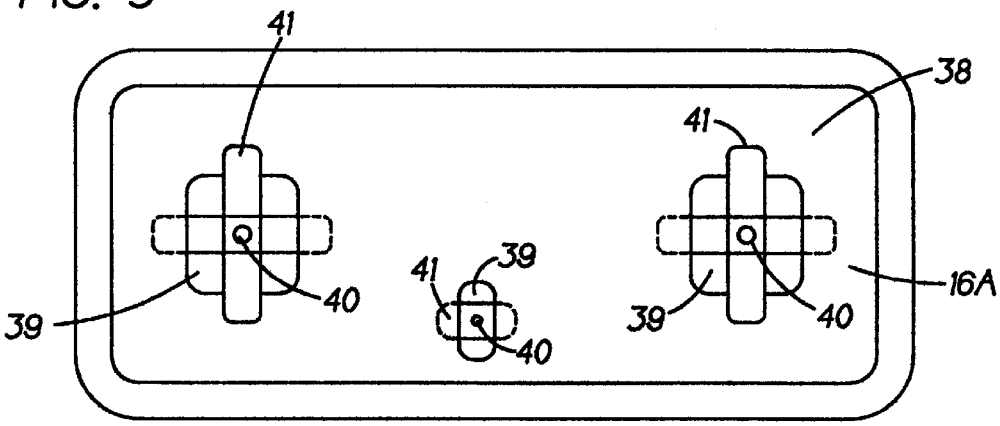
FIG. 5 is a view looking down into the outer tank at the bottom of the tank.

The bottom 38 of the china tank 14 (FIG. 5) contains large openings 39 which are designed to receive the mounting bolts 40 and washer "T"s 41 for attachment to a gravity feed bowl. The openings 39 are large so that the china tank can be mounted on any gravity feed bowl (the location of the mounting bolts is different for different gravity flow bowls) The bottom of the china tank is accordingly not water sealed. Sealing the outer tank is not required since the inner tank (canister) is normally empty and thus condensate will not form on the outer walls of the canister.

Figure 6:
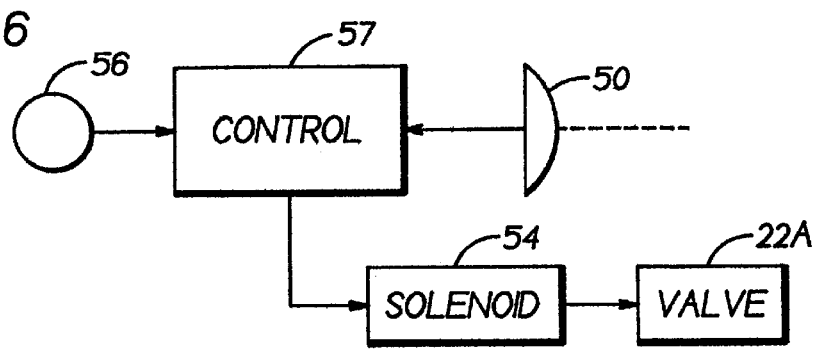
FIG. 6 is a schematic illustration of a second embodiment of the invention.
Figure 7:
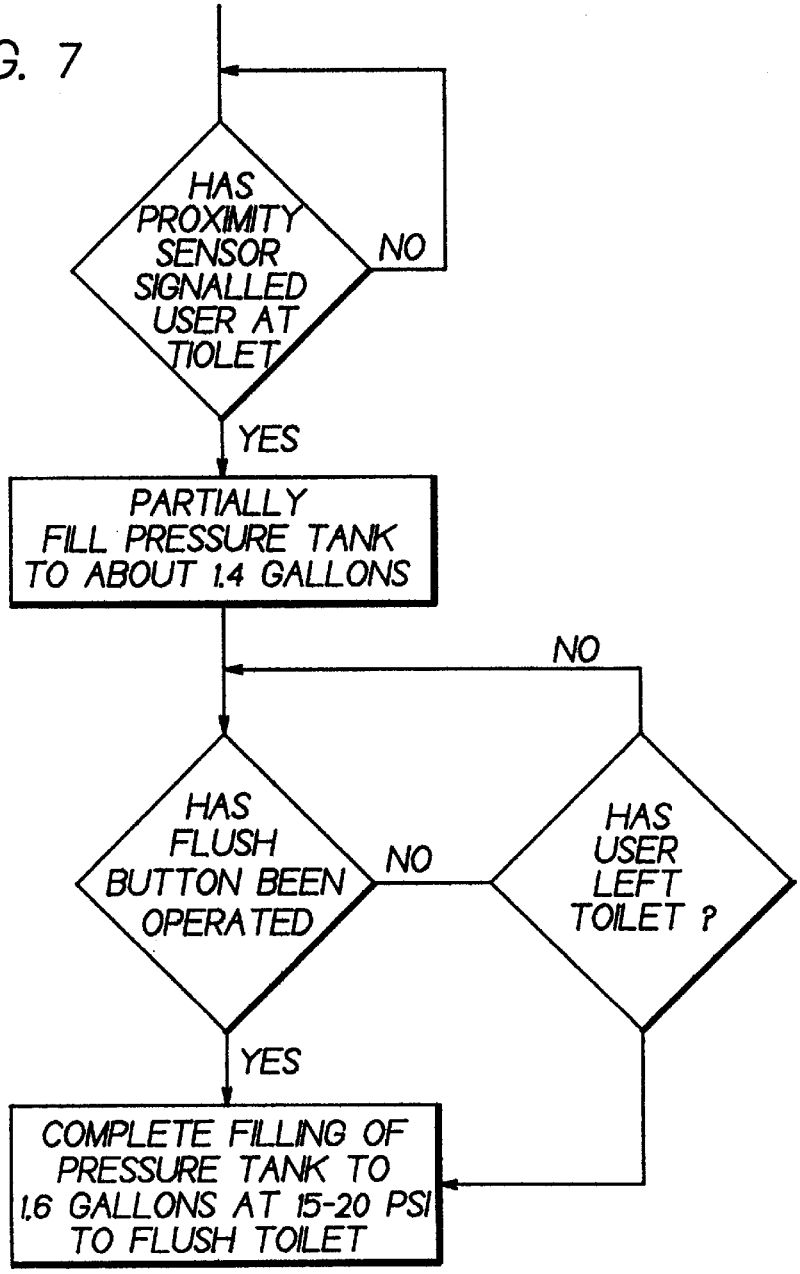
FIG. 7 is a algorithm illustrating the operation of the second preferred embodiment.

Since the pressure tank is empty until the toilet flush handle is operated, flushing will not occur for approximately 20 seconds until the pressure tank has been charged with 1.6 gallons of water at 15–20 PSI). To eliminate this wait time the cycle can be electronically controlled by a battery powered circuit. A sensor such as a proximity sensor 50 (FIG. 6) which determines that a person is at the toilet, can supply a signal to a control 52 which will operate a solenoid 54 to open for a set time and then close the fill valve 22A to admit about 1.4 gallons of water into the pressure tank (FIG. 7). When the flush button 56 is operated, a signal will be supplied to the control to operate the solenoid 54 a second time to open the fill valve 22A for a time sufficient to complete the charging of the canister with 1.6 gallons at a selected pressure of from 15–20 PSI. The float valve 27 then closes the fill tube which in turn triggers open the discharge valve 26 which allows the 1.6 gallons of water to be discharged at a pressure that can be handled by a conventional gravity flow bowl 10 to flush the bowl. In the event that the flush button 56 is not operated and the sensor 50 determines that the user has left the toilet, the control will operate the solenoid 54 automatically to initiate the flush, so that the pressure tank will not be pressurized except for brief periods during use.

Figure 8:
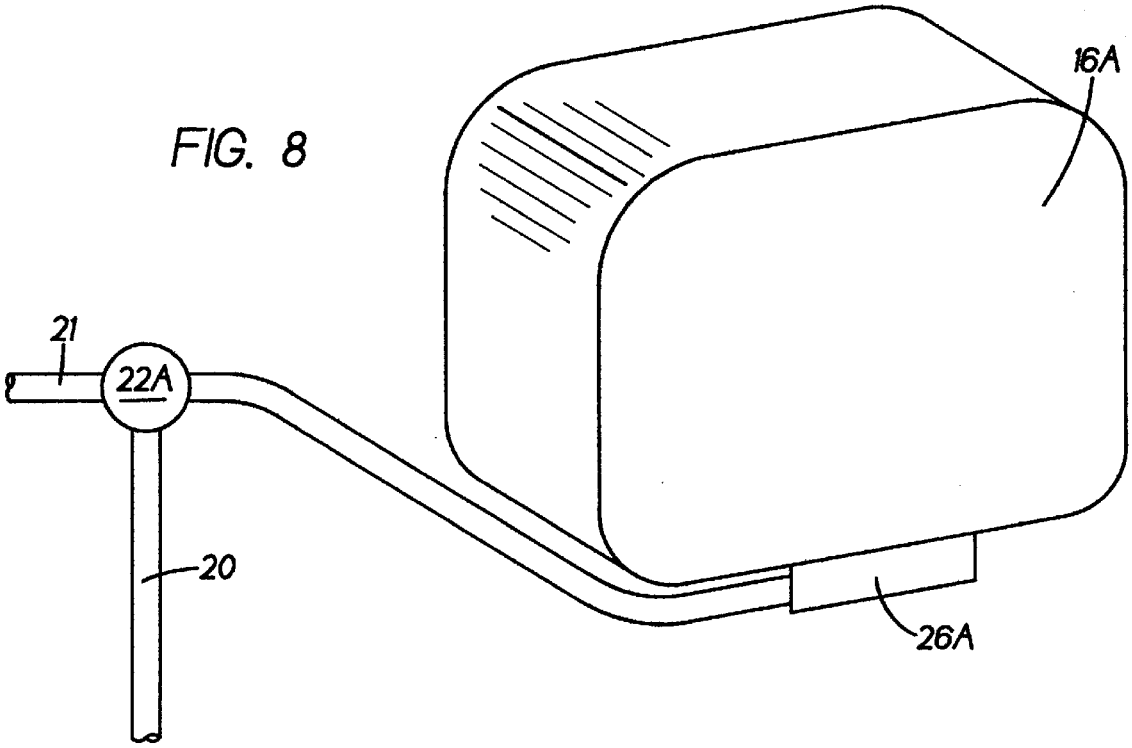
FIG. 8 is an oblique view of the pressure tank of a third embodiment of the invention.

Alternatively, a pressure canister 16A (FIG. 8) meeting the A.S.M.E pressure vessel code specifications, can be injection molded in a shape that will fit within a conventional gravity flow tank. When the flush handle 21 is operated, the flush valve 26A of the already charged pressure tank 16A, which holds 1.6 gallons of water at a pressure limited to no more than about 15–20 PSI, is triggered to open thereby releasing the 1.6 gallons to flush the standard gravity flow bowl 10. Immediately following this release, the fill valve 22A will open until the pressure tank is recharged.

We claim:

1. A pressure assist toilet which is to be charged immediately before flushing with a predetermined volume of water at a predetermined pressure including a bowl, a pressure tank, means for admitting into said pressure tank, immediately preceding the flushing of the toilet, a selected volume of water which is less than said predetermined volume, a flush valve operable when said pressure tank contains said predetermined volume of water at said predetermined pressure to release the water in said pressure tank to flush the toilet, and flushing means including an actuator for admitting water into said pressure tank so that said selected volume of water contained by said pressure tank will be increased until said pressure tank contains said predetermined volume of water at said predetermined pressure whereupon said flush valve will operate to flush the toilet.

2. A pressure assist toilet which is to be charged immediately before flushing with a predetermined volume of water at a predetermined pressure including a bowl, a pressure tank, a fill valve selectively operable to admit water under pressure into said pressure tank, means for admitting into said pressure tank a selected volume of water which is less than said predetermined volume preceding the flushing of the toilet including sensor means for sensing that a person is at the toilet, and control means including means for operating said fill valve, when said sensor means senses that a person is at the toilet, until said pressure tank contains said selected volume of water whereby said selected volume of water will be held by said pressure tank.

3. A pressure assist toilet according to claim 1, further comprising means for flushing said bowl when said pressure tank contains said predetermined volume of water at said predetermined pressure including a flush valve for discharging water in said pressure tank into said bowl when open, and flush actuator means, said control further including means for operating said fill valve, when said flush actuator means is operated whereby water will be admitted into said tank until said pressure tank is filled with said predetermined volume of water at said predetermined pressure and for opening said flush valve when said pressure tank is filled with said predetermined volume of water at said predetermined pressure thereby releasing said predetermined volume of water from said pressure tank through said flush valve into said bowl to flush said bowl.

4. A pressure assist toilet according to claim 3, wherein said control further comprises means, in the event a user leaves the toilet and said actuator means is not operated, for operating said fill valve to fill said pressure tank with said predetermined volume of water at said predetermined pressure and for opening said flush valve when said pressure tank is filled with said predetermined volume of water at said predetermined pressure thereby releasing said predetermined volume of water from said pressure tank through said flush valve into said bowl to flush said bowl.

5. A pressure assist toilet comprising a gravity flow bowl including a plurality of upwardly projecting mounting bolts, a gravity flow tank, a plastic pressure tank, said plastic pressure tank being selectively configured for insertion into said gravity flow tank, means for charging said pressure tank with a predetermined volume of water at a pressure from at least about 15 PSI to no more than about 20 PSI immediately preceding the flushing of the toilet, and means for releasing said predetermined volume of water from said pressure tank to said gravity flow bowl to flush said gravity flow bowl, said gravity flow tank including a bottom having a plurality of large openings extending therethrough selectively configured to receive a corresponding number of mounting bolts of any of a variety of gravity flow toilet bowls having mounting bolts located at different positions, and fastening means for cooperating with said mounting bolts for securing said gravity flow tank on said gravity flow bowl without sealing said large openings.

6. A pressure assist toilet according to claim 5, wherein said pressure tank is blow molded from plastic.

* * * * *